US005398602A

United States Patent [19]

Taylor

[11] Patent Number: 5,398,602

[45] Date of Patent: Mar. 21, 1995

[54] REGISTRATION DEVICE FOR POSITIONING SILK SCREEN FRAME AGAINST SMOOTH, FLAT SURFACE

[76] Inventor: Kim S. Taylor, 3479 E. 7550 South, Salt Lake City, Utah 84121

[21] Appl. No.: 120,683

[22] Filed: Sep. 13, 1993

[51] Int. Cl.[6] ..... B41M 1/12; B41L 13/00

[52] U.S. Cl. ..... 101/129; 101/114; 101/128.1; 101/407.1; 248/205.8; 248/206.3; 40/617

[58] Field of Search ..... 101/114, 115, 127.1, 101/128, 128.1, 129, DIG. 36, 363, 407.1, 474; 248/205.5, 205.6, 205.7, 205.8, 205.9, 206.1, 206.2, 206.3; 434/87; 40/152, 155, 606, 617

[56] References Cited

U.S. PATENT DOCUMENTS

| | | | |
|---|---|---|---|
| 1,324,044 | 12/1919 | Harris | 101/114 |
| 1,468,197 | 9/1923 | Downing | 40/617 X |
| 1,534,751 | 4/1925 | Wallick | 101/415 |
| 1,685,102 | 9/1928 | Summerhayes, Jr. | 40/617 X |
| 1,686,924 | 10/1928 | Oberhauser | 101/474 |
| 1,810,221 | 6/1931 | O'Connell | 101/114 X |
| 1,835,980 | 12/1931 | Hallowell | 40/606 |
| 1,859,594 | 5/1932 | Meyer et al. | 248/206.3 |
| 2,148,563 | 2/1939 | Kingsley | 101/474 |
| 2,590,410 | 3/1952 | Hurley | 248/206.3 |
| 2,616,145 | 11/1952 | Dufford | 101/114 X |
| 2,634,077 | 4/1953 | Van Dusen | 248/205.8 |
| 2,867,275 | 1/1959 | Laufer | 101/407.1 X |
| 2,982,205 | 5/1961 | Maul | 101/407.1 X |
| 3,654,858 | 4/1972 | Rick | 101/269 |
| 3,704,668 | 12/1972 | St. Onge et al. | 101/269 |
| 3,818,829 | 6/1974 | Patterson, Jr. | 101/269 |
| 4,083,302 | 4/1978 | Bello et al. | 101/269 |
| 4,641,577 | 2/1987 | Sweeny | 101/415.1 |
| 5,246,193 | 9/1993 | Faidley | 248/206.3 |

*Primary Examiner*—Edgar S. Burr
*Assistant Examiner*—Christopher A. Bennett
*Attorney, Agent, or Firm*—Terry M. Crellin

[57] ABSTRACT

A device and method for positioning a silk screen frame containing a silk screen against a large, smooth, flat surface such as glass. A pair of hand operated suction cups are mounted in spaced apart positions on an elongate mounting member. The suction cups are adapted to be secured by vacuum to the flat surface. A pair of clamps are mounted on the elongate mounting member between the suction cups. The clamps are adapted to clamp the edge of a silk screen frame and maintain the silk screen frame in flatwise position against the flat surface. The various silk screen frames containing separate silk screens of the design to be applied on the flat surface can be successively clamped in place in substantially identical positions on the flat surface, and if any one of the silk screen frames has to be repositioned after it has been removed from the device, it can quickly be reclamped in substantially the identical position as its original position before being removed.

11 Claims, 2 Drawing Sheets

REGISTRATION DEVICE FOR POSITIONING SILK SCREEN FRAME AGAINST SMOOTH, FLAT SURFACE

BACKGROUND OF THE INVENTION

1. Field of the Invention

The present invention relates to manually operated apparatus for positioning and holding a silk screen mounted in a silk screen frame against a large, smooth, flat surface. In particular, the present invention relates to such manually operated apparatus employing suction vacuum cups for attaching the apparatus to a large, smooth, flat surface, and with the apparatus being adapted to clamp a silk screen frame to the apparatus and simultaneously hold the silk screen frame against the large, smooth, flat surface.

2. State of the Art

It is often desirable to silk screen a design on a large, flat, smooth surface. Commonly, the surface will be glass, but quite often it is desired to silk screen a design to other flat, smooth surfaces such as polished mineral surfaces, synthetic panels simulating polished mineral surfaces, polished wood surfaces, or a wall surface that has been prepared so as to have a smooth, flat surface. Heretofore, it has been common practice to utilize three workmen in accomplishing the silk screening of the desired design on the large, flat surface.

When the surface on which the design is to be silk screened is an upstanding or vertically disposed surface, it is common to employ two workmen to carefully hold the silk screen frame and the silk screen carried by the silk screen frame against the large, flat surface, while a third workman applies the coloring material through the silk screen and onto the large, flat surface. It takes the third workman a significant amount of time to apply the coloring material to the silk screen and work the coloring material through the silk screen to the large, flat surface.

It is a difficult task for the first two workmen to hold the silk screen frame in a steady, exact position while the third workmen applies the coloring material. Often times, the two workmen holding the silk screen frame will tire, and the silk screen frame will be allowed to move ever so slightly. Even a very small movement of the silk screen frame will result in the design applied to the large, flat surface being of inferior quality or of no value at all. Generally, the inferior quality design must be removed and the entire process repeated.

It would be highly desirable to have a manually operated device that employs manually operated vacuum suction cups for being secured to the large, flat surface and which when so secured to the large, flat surface can be used by a single workman to accurately position and securely hold the silk screen frame to the large, flat surface. Such a manually operated device would eliminate the chance of the silk screen frame from slipping or moving during the application of coloring material. Further, the registration of the numerous succession of silk screen frames used in making the design could be controlled to be much more accurate than presently obtainable when manually holding the silk screen frames on the large, flat surface.

Such a manually operated device would also be advantageous to use on large, horizontal printing tables that have substantially horizontal, flat surfaces. Heretofore, registration devices have been available for holding silk screen frames on the upper surface of such a table, but the registration devices have been screwed or secured with other type mechanical attachments to the surface of the table. After the registration devices have been moved numerous times, the surface of the table becomes unusable and must be replaced. If the surface of the table was formed with a large, flat, smooth surface, a manually operated registration device employing vacuum cups could be repeatedly moved an innumerable number of times without causing any substantial damage to the surface of the table. In addition, the movement of a registration device employing manually operated, vacuum suction cups can be accomplished much more rapidly and with far less labor expense that when moving the mechanically attached devices of the prior art.

3. Objectives

The principal objective of the invention is to provide a novel, registration device for use in holding silk screen frames against large, flat, smooth surfaces. A particular objective of the present invention is to provide such a manually operated device employing manually operated, vacuum suction cups which is adapted to be quickly and easily mounted on a large, flat, smooth surface and is capable of accurately positioning and securely holding a silk screen frame against the large, flat, smooth surface while coloring matter is applied to the surface through the silk screen carried by the silk screen frame.

BRIEF DESCRIPTION OF THE INVENTION

The above objectives are achieved in accordance with the present invention by providing a novel registration device for positioning a silk screen frame containing a silk screen against a large, smooth, flat surface. The device of the present invention has a pair of hand operated, vacuum suction cups mounted in spaced apart positions on an elongate mounting member. The hand operated, vacuum suction cups can be quickly mounted to a large, smooth, flat surface to securely hold the vacuum suction cups and the elongate mounting member to the flat surface. The surface can be any smooth surface to which a vacuum suction cup will attach itself. Such surfaces include glass panes or panels as well as polished surfaces made of wood, minerals or synthetic plastic materials.

A pair of clamps are mounted on the elongate mounting member between the vacuum suction cups, and the clamps are adapted to clamp the edge of a silk screen frame to the registration device of the present invention and to maintain the silk screen frame in flatwise position against the smooth, flat surface. A silk screen is carried by the silk screen frame, and coloring matter is applied through the silk screen in a manner well known in the art while the silk screen frame is being held against the flat surface.

A succession of silk screen frames containing the various silk screens to be used in producing the desired design can quickly be clamped to the device of the present invention after the device has been secured to the flat, smooth surface so that the various silk screens of the silk screen frames will be accurately positioned to produce a high quality design on the flat surface. The various silk screen frames containing the separate silk screen elements of the desired design that is to be applied to the smooth, flat surface can quickly and accurately positioned in substantially identical positions on the flat surface, and there is no chance of the silk screen frame slipping or moving as colored material is applied through the silk screen element to the flat surface. If it becomes necessary to reposition any one of the silk screen frames after such frame has been removed from the device of the present invention, that frame can quickly be reclamped to the device so that the frame will be located in substantially the identical position as its original position before being removed from the device.

Additional objects and features of the invention will become apparent from the following detailed description, taken together with the accompanying drawings.

THE DRAWINGS

A preferred embodiment of the present invention representing the best mode presently contemplated of carrying out the invention is illustrated in the accompanying drawings in which.

DETAILED DESCRIPTION OF THE ILLUSTRATED EMBODIMENTS

Figure 1:
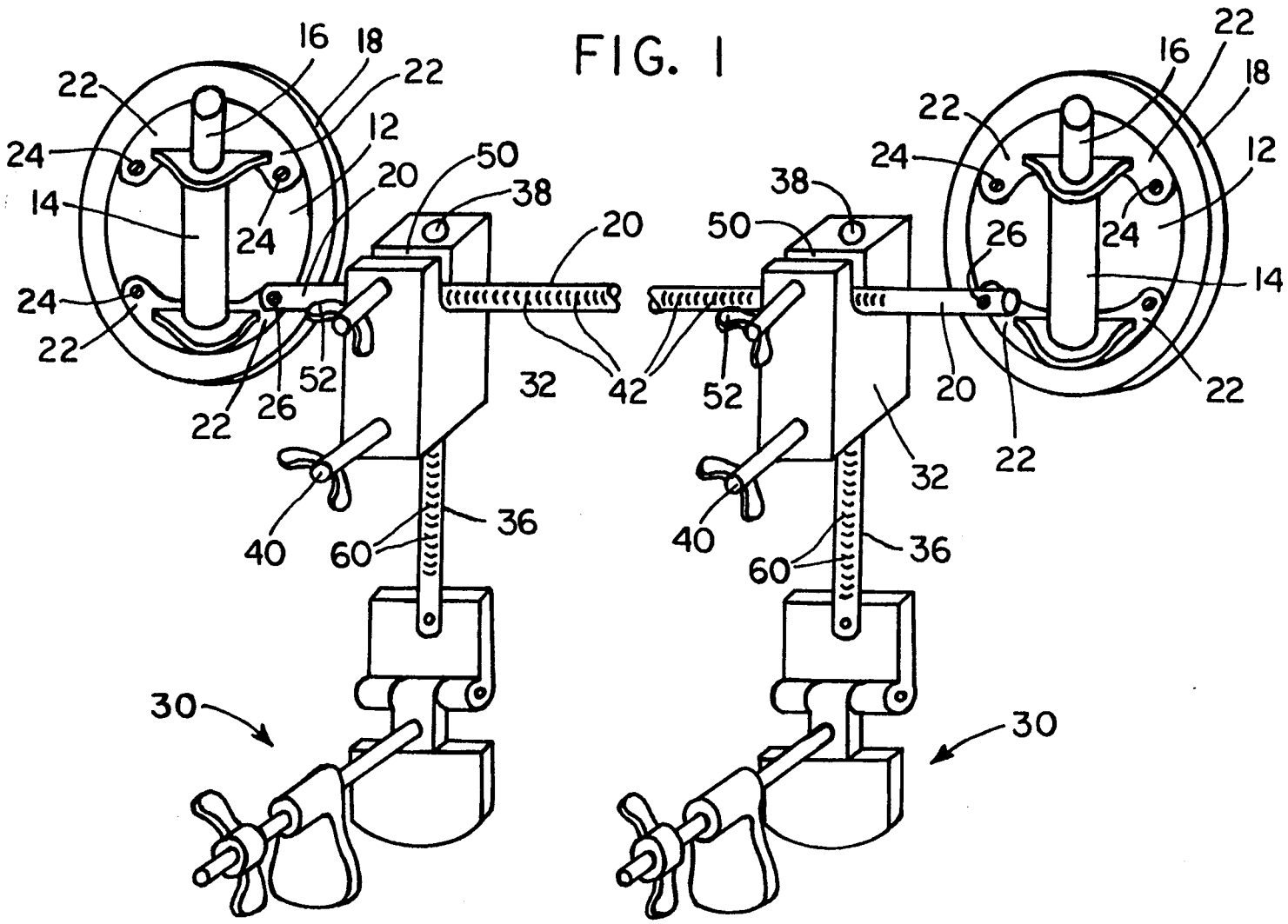
FIG. 1 is a pictorial representation of a device in accordance with the present invention.

Referring now to the drawings, there is shown one preferred embodiment of a novel registration device in accordance with the present invention. The device comprises a pair of hand operated vacuum suction cups 12. These suction cups are standard items of commerce and are commonly used in picking up and carrying panes of glass and other similar flat, smooth items. For purposes of the present invention, it is advantageous to use vacuum suction cups 12 that are provided with handle grips 14 which can be grabbed by one's hands. The handle grip 14 is provided with a longitudinal plunger 16 at one of the ends of the handle grip 14. When one grabs the handle grip 14, the plunger 16 can be operated with one's thumbs.

The suction cups 12 have a resilient elastomeric gripping pads 18 facing away from the handle grips 14. When the gripping pads 18 are placed flatwise against a flat, smooth surface, the plungers 16 can be depressed several times to draw a vacuum between the gripping pads 18 and the flat, smooth surface. The vacuum developed between the gripping pads 18 and the flat, smooth surface firmly secures the vacuum suction cups against the flat, smooth surface. The basic vacuum suction cups 12 as shown in the drawings are sold by the Woods Powr-Grip Company of Wolf Point, Mont. under the name of "Spring Powered Pump Units."

Figure 2:
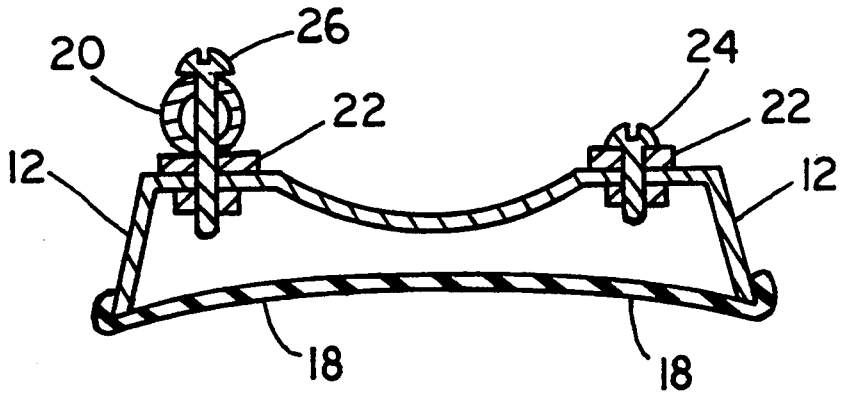
FIG. 2 is a vertical cross section taken along line 2—2 of FIG. 1.

In accordance with the present invention, an elongate mounting member 20 is provided with the pair of vacuum suction cups 12 mounted in spaced apart positions on the elongate mounting member 20. As is illustrated in FIGS. 1 and 2, the elongate mounting member 20 can be hallow circular conduit such as a common tubing. The mounting member 20 could also be from a solid, elongate rod instead of the hollow conduit illustrated in the drawings. The vacuum suction cups are preferably mounted at the opposite ends of the elongate member 20. As shown in FIG. 2 of the drawings, it is advantageous to attach the opposite ends of the elongate member 20 to the back frames 22 of the respective vacuum suction cups 12 by replacing one of the screws 24 that holds the handle grip 14 to the back frame 22 of the vacuum suction cup 12 with a longer screw 26 that passes through an opening in the end of the elongate member 20. The screw 26 firmly attaches the respective end of the elongate member 20 to a respective vacuum suction cup 12.

A pair of clamps 30 are mounted on the elongate mounting member 20 between the vacuum suction cups 12. The clamps 30 are adapted to clamp the edge of a silk screen frame (not shown in the drawings) and maintain the silk screen frame in flatwise position against the smooth, flat surface to which the vacuum suction cups 12 have been secured. In applying a design to the flat surface, several silk screens are used, with each silk screen being carried in a separate silk screen frame. The various silk screen frames can be successfully clamped in place in substantially identical positions on the flat surface and the silk screen frame is held securely so that it cannot slip or move as the coloring material is applied to the flat surface through the silk screen contained by the silk screen frame.

In the preferred embodiment illustrated in the drawings, means are provided for moving the clamps 30 back and forth along the elongate mounting member 20. As illustrated, the means for moving the clamps 30 back and forth along the elongate member 20 comprises a pair of slide members 32 that can slide back and forth along the elongate member 20. Means are further provided for attaching each clamp 30 to a respective slide member 32.

In the preferred embodiment illustrated in the drawings, the clamps 30 are attached to the respective slide members 32 so as to allow the respective clamp 30 to move toward and away from its associated slide member 32 in rectilinear motion substantially perpendicular to the movement of the slide members 32 on the elongate member 20. Further, means are provided on each slide member 32 for releasably locking the clamp 30 that is associated with the particular slide member 32 in any desired position in the rectilinear movement of the clamp 30 relative to the slide member 32.

Figure 3:
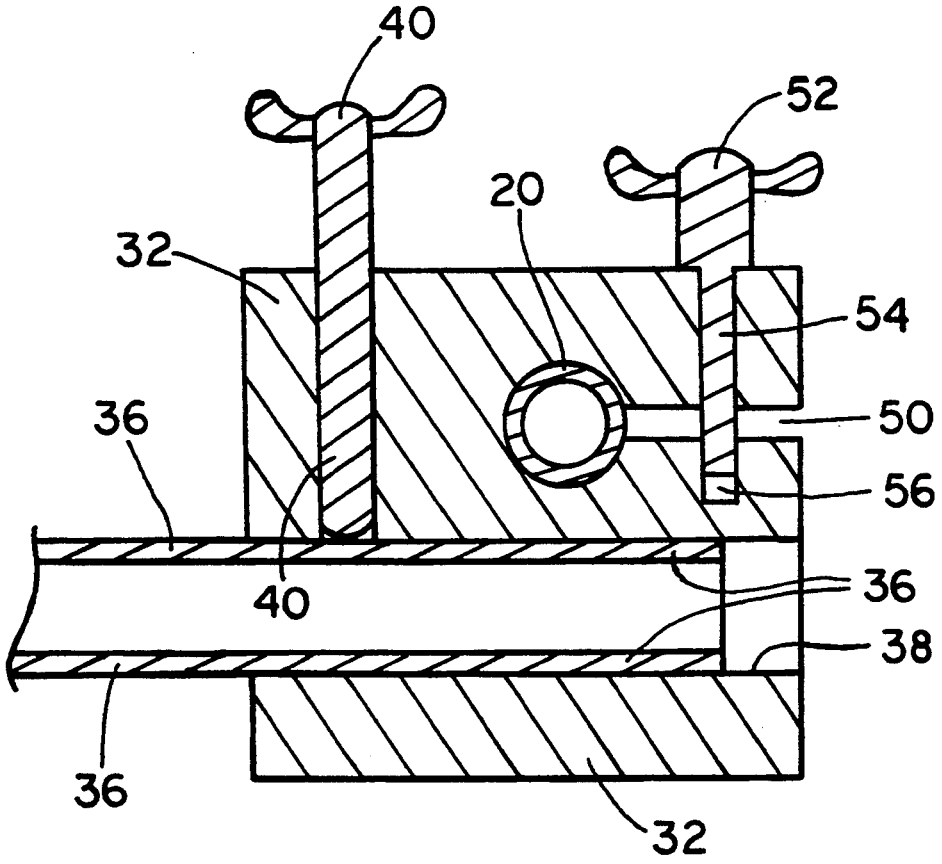
FIG. 3 is a vertical cross section taken along line 3—3 of FIG. 1.

As best illustrated in FIGS. 1 and 3, one preferred embodiment of means for attaching each clamp 30 to its respective slide member 32 comprises an elongate rod 36 that extends from the clamp 30. A bore 38 extends through the slide member 32 and receives the elongate rod 36 of the clamp 30 for longitudinal movement of the elongate rod back and forth in the bore 38. A locking means is provided on the slide member 32 for releasably securing the elongate rod 36 of the clamp 30 in the bore 38 so that the rod 36 can be firmly secured at any desired position in its travel through the bore 38 and thereafter released for movement to another desired position in the bore 38. As illustrated, this locking means comprises a wing screw 40 that is threaded into a threaded bore in the slide member 32, whose internal end opens into the bore 38 in which the rod 36 is received. As the wing screw 40 is threaded inwardly, its inner end engages and locks the rod 36 in place. Unscrewing the wing screw 40 releases the rod 36 and allows it to be moved to any new desired position in its travel through the bore 38.

It is advantageous to provide registration means for accurately positioning the clamps 30 at set positions on the elongate member 20. Such registration means conveniently utilize the slide members 32 described above. The slide members 32 act as registration members when used with calibration means that is associated with the elongate member 20. The calibration means advantageously comprises a set of equally spaced indicia 42 provided along the longitudinal length of the elongate member 20 and an index indicia on the registration members, i.e., the slide members 32. The index indicia on the slide members 32 is conveniently the end edges of the bores in the slide members 32 through which the elongate member 20 are received. These edges on the sides of the slide members 32 can be set to be in registration with any selected portion of the indicia 42 on the elongate member 20 as the slide members 32 move back and forth along the elongate member 20.

Means are preferably provided on each slide member 32 for releasably securing the slide member 32 to the elongate member 20, such that the slide member 32 can be firmly secured to the elongate member 20 at any desired position in its travel along the elongate member 20 and thereafter released for movement to another desired position. As illustrated in FIGS. 1 and 3, the means for securing the slide member 32 to the elongate member comprises a slot 50 extending from an upper side of the slide member 32. The inner end of the slot 50 opens along the full length of the bore through which the elongate member 20 passes.

A winged nut 52 has a threaded screw 54 extending therefrom, with the threaded screw 54 passing through a bore in the slide member that extends from the side face of the slide member and intersects the slot 50. This bore extends beyond the slot 50 slightly and this portion of the bore is identified by the reference numeral 56 in FIG. 3 of the drawings. The portion 56 of the bore that extends beyond the slot 50 is threaded. As the winged nut 52 is turned so as to advance the inner end of the threaded screw 54 into the threaded portion 56 of the bore, the winged nut 52 forces the slot 50 to close slightly and thus clamp the elongate member 20 tightly in the bore through which the elongate member passes. When the winged nut 52 is unscrewed, the clamping action on the elongate member 20 is released, and the slide member 32 is again free to move along the elongate member 20.

Registration means are also advantageously provided for accurately positioning each clamp 30 at set positions relative to its respective slide member 32. As illustrated in FIG. 3, this second registration means comprises a set of equally spaced indicia 60 provided along the longitudinal length of the elongate rod 36 associated with the clamp 30 as well as an index indicia on the slide member 32 that registers with the indicia 60 on the elongate rod 36. The index indicia on the slide member 36 that registers with the indicia on the elongate rod 36 is advantageously formed by the end edge of the bore 38 through which the elongate rod 36 passes. As the elongate rod 36 moves back and forth in the bore 38, indicia 60 on the elongate rod 36 registers with the end edge of the bore 38 in the slide member 32 for determining precise position of the elongate rod 36 (and thus the clamp 30) relative to the slide member 32.

Although a preferred embodiment of the registration device of the present invention has been illustrated and described, it is to be understood that the present disclosure is made by way of example and that various other embodiments are possible without departing from the subject matter coming within the scope of the following claims, which subject matter is regarded as the invention.

I claim:

1. A device for positioning a silk screen frame containing a silk screen against a large, smooth, flat surface such as glass, said device comprising a pair of hand operated suction cups mounted in spaced apart positions on an elongate mounting member, said suction cups being adapted to be secured by vacuum to said smooth, flat surface;

a pair of clamps mounted on said elongate mounting member between said suction cups, said clamps being adapted to clamp the edge of a silk screen frame and maintain the silk screen frame in flatwise position against the smooth, flat surface; and means for moving said clamps back and forth along said elongate mounting member, said means for moving said clamps back and forth along said elongate member comprising a pair of slide members that slide back and forth along said elongate member; and means for attaching each clamp to a respective slide member, whereupon various silk screen frames containing separate silk screens that are to be used in applying a design on the smooth, flat surface can be successively clamped in place in substantially identical positions on the smooth, flat surface, and if any one of the silk screen frames has to be repositioned after it has been removed from the device, it can quickly be reclamped in substantially the identical position as its original position before being removed.

2. A device in accordance with claim 1 wherein said means for attaching each clamp to its respective slide member allows the clamp to move toward and away from said slide member in rectilinear motion substantially perpendicular to the movement of the slide member on said elongate member, and means are further provided on each slide member for releasably locking said clamp that is coupled thereto in any desired position in its rectilinear movement relative to said slide member.

3. A device in accordance with claim 2 wherein said means for attaching each clamp to its respective slide member comprises an elongate rod extending from said clamp;

a bore through said respective slide member for receiving the elongate rod of said clamp for longitudinal movement of said elongate rod back and forth in said bore; and means on said slide member for releasably securing said elongate rod of said clamp in said bore of said slide member, whereby said elongate rod can be firmly secured at any desired position in its travel through said bore and thereafter released for movement to another desired position in said bore.

4. A device for positioning a silk screen frame containing a silk screen against a large, smooth, flat surface such as glass, said device comprising a pair of hand operated suction cups mounted in spaced apart positions on an elongate mounting member, said suction cups being adapted to be secured by vacuum to said smooth, flat surface;

a pair of clamps mounted on said elongate mounting member between said suction cups, said clamps being adapted to clamp the edge of a silk screen frame and maintain the silk screen frame in flatwise position against the smooth, flat surface;

means for moving said clamps back and forth along said elongate mounting member; and registration means coupled with each clamp for accurately positioning said clamps at set positions on said elongate mounting member, whereupon various silk screen frames containing separate silk screens that are to be used in applying a design on the smooth, flat surface can be successively clamped in place in substantially identical positions on the smooth, flat surface, and if any one of the silk screen frames has to be repositioned after it has been removed from the device, it can quickly be reclamped in substantially the identical position as its original position before being removed.

5. A device for positioning a silk screen in accordance with claim 4 wherein said registration means comprises a pair of registration members with each registration member being coupled to a respective clamp, and wherein each registration member and the respective clamp coupled thereto moves back and forth along said elongate member; and calibration means that cooperate with said registration member for determining precise positions of said registration members relative to said elongate member as said registration member moves along said elongate member.

6. A device for positioning a silk screen in accordance with claim 5 wherein each registration means comprises a slide member that slides along said elongate member; and means are provided on each slide member for releasably securing the slide member to said elongate member, whereby the slide member can be firmly secured to said elongate member at any desired position in its travel along said elongate member and thereafter released for movement to another desired position.

7. A device for positioning a silk screen in accordance with claim 5 wherein said calibration means comprises a set of equally spaced indicia along the longitudinal length of said elongate member and an index indicia on said registration member that moves relative to said spaced indicia on said elongate member and can be set to be in registration with any selected portion of the indicia on said elongate member.

8. A device for positioning a silk screen in accordance with claim 6 wherein each clamp is coupled to a respective slide member such that the clamp can be moved rectilinearly in a direction substantially perpendicular to the movement of said slide member on said elongate member; and second registration means are provided for accurately positioning each clamp at set positions relative to said respective slide member.

9. A device for positioning a silk screen in accordance with claim 8 wherein said second registration means comprises an elongate rod extending from each clamp;

a bore through each slide member for receiving an elongate rod from a respective clamp for longitudinal movement of said elongate rod back and forth in said bore;

means are provided on each slide member for releasably securing the respective elongate rod in said bore of said slide member, whereby the elongate rod can be firmly secured at any desired position in its travel through said bore and thereafter released for movement to another desired position in said bore; and second calibration means on each clamp that cooperates with a respective slide member for determining precise positions of said elongate rod relative to said slide member as said elongate rod moves back and forth in said bore of said slide member.

10. A device for positioning a silk screen in accordance with claim 9 wherein said second calibration means comprises a set of equally spaced indicia along the longitudinal length of said elongate rod and an index indicia on the slide member that registers with said indicia on said elongate rod.

11. A method for positioning a silk screen frame containing a silk screen against a large, smooth, flat surface such as glass, said method comprising mounting a pair of hand operated suction cups on an elongate mounting member;

mounting a pair of clamps on said elongate mounting member between said suction cups;

securing said suction cups to said flat surface so that said clamps are positioned in spaced apart relationship adjacent to the surface of said flat surface; and securing said silk screen frame to said pair of clamps so that said silk screen frame is held in a firm, stable position lying flatwise against said flat surface.

* * * * *